US005512723A

United States Patent [19]

Joshi

[11] Patent Number: 5,512,723

[45] Date of Patent: Apr. 30, 1996

[54] SELF-CLEANING TYPE SWITCH

[75] Inventor: Masaharu Joshi, Nara, Japan

[73] Assignee: Hosiden Corporation, Osaka, Japan

[21] Appl. No.: 226,821

[22] Filed: Apr. 13, 1994

[30] Foreign Application Priority Data

Apr. 26, 1993 [JP] Japan ..... 5-021851

[51] Int. Cl.[6] ..... H01H 13/14

[52] U.S. Cl. ..... 200/530; 200/531; 200/536; 200/253; 200/252

[58] Field of Search ..... 200/520, 530, 200/531, 532, 536, 341, 5 A, 510, 547, 549, 550, 252, 253, 257, 512, 302.2

[56] References Cited

U.S. PATENT DOCUMENTS

| | | | |
|---|---|---|---|
| 3,940,585 | 2/1976 | Schaad | 200/302.2 |
| 4,704,503 | 11/1987 | Takasawa | 200/531 |
| 4,766,272 | 8/1988 | Guzzon | 200/302.2 |
| 5,382,767 | 1/1995 | Takano et al. | 200/530 |

*Primary Examiner*—Henry J. Recla
*Assistant Examiner*—David J. Walczak
*Attorney, Agent, or Firm*—Pollock, VandeSande & Priddy

[57] ABSTRACT

A switch compartment 20R is formed in a switch body 20 of electrically insulating material and opens at the top surface of the body. First and second fixed contact members 23C, 24C are secured to the opposed inner walls of the compartment. The open top of the compartment is closed by a cover having a through-bore 32 facing the compartment. An actuator 10 is accommodated in the compartment and outwardly biased by a coil spring 26. The actuator 10 comprises a stem portion 13 protruding through the through-bore and a contact holder block 12 joined to the lower end of the stem portion. The holder block has a housing slot 11 extending therethrough from its front end face to its rear end face. The undersurface of the holder block is formed with a guide slit 18 extending therethrough from the front end face to the rear end face in communication with the housing slot. A movable contact member 19 is placed into the housing slot by inserting a pin 41 through the coiled portion 19B of the contact member and moving the pin along the guide slit from the front end face toward the rear end face of the holder block. The holder block is formed with slit-like windows through the opposed side walls thereof, the windows communicating with the housing slot so that the first and second contact portions of the movable contact member in the housing slot may protrude through the windows into slidable contact with the first and second fixed contact members.

13 Claims, 6 Drawing Sheets

SELF-CLEANING TYPE SWITCH

FIELD OF THE INVENTION

This invention pertains generally to microswitches for use in sensing a floppy disk, a video cassette and the like, and particularly to self-cleaning type microswitches which facilitate the insertion the, movable contact members.

BACKGROUND ART

Referring to FIGS. 1 to 4, there is shown a microswitch of the type described herein as disclosed in the prior Japanese Utility Model Application Kokai No. 1-132025 commonly assigned to the assignee of the present invention.

As seen in FIG. 1 which is an exploded view, this microswitch comprises a generally rectangular body 20 formed of an electrically insulating material, actuators 10, coil springs 26 for biasing the respective actuators ]0 outwardly, a cover 30 of an electrically insulating material closing the top of the body 20, and movable contact members in the form of contact springs 19 associated with the respective actuators.

The body 20 is formed with a pair of juxtaposed open topped switch compartments 20R for accommodating the associated actuators to constitute two switch circuits, only one of which is shown in the drawings. As illustrated in FIG. 2 which is a cross-sectional view taken along line II—II in FIG. 1, first and second fixed contact members 23C and 24C are secured to the opposed inner walls of each of the switch compartments 2OR.

The cover 30 has a pair of through-bores 32 extending therethrough in facing relation with the respective compartments 20R and a pair of vertically extending tubular guide portions 33 integrally formed therewith in concentric alignment with and communicating with the respective through-bores 32.

The cover 30 further has a pair of U-shaped catch lugs 31 depending from its opposite side edges which are engageable with corresponding detent pawls 28 protruding from the opposed side walls of the body 20 to thereby lock the cover to the body. As seen in FIGS. 1 and 2, first and second terminals 23 and 24 integral with the first and second fixed contact members 23C and 24C, respectively extend out from one outer side wall of the body 20.

Each of the actuators 10 comprises a flat generally box-shaped contact holder block 12 and an integral vertical stem portion 13 upstanding from the top surface of the holder block and adapted to be accommodated in the associated compartment 20R with the coil spring 26 disposed between the undersurface of the holder block and the bottom wall of the compartment. The stem portion 13 is telescopically inserted through the through-bore 32 in the cover 30 and the tubular guide portion 33.

The contact spring 19 is made of a single piece of resilient wire bent so as to form a central coiled portion 19B and a pair of arms 19A extending from the opposite ends of the coiled portion with an angle of about 70° therebetween, the arms 19A being inwardly bent toward each other at about 90° adjacent their outer free ends to form first and second convex contact portions 19C1 and 19C2.

The contact spring 19 is held in a flat housing slot 11 in the holder block 12 of the actuator 10, the housing slot 11 extending in the holder block from one end face (front end face) 12A toward the opposed end face (rear end face) 12B of the block parallel to the top surface of the block and dissecting the front end face 12A.

The holder block 12 is formed with slits 14 through the opposed side walls 12C, 12D perpendicular to the front end face 12A, the slits 14 communicating with the housing slot 11 so that the first and second convex contact portions 19C1, 19C2 of the contact spring 19 may protrude out through the slits. Extending generally perpendicularly from the front end face 12A and rear end face 12B are guide projections 15 and 16, respectively which are adapted to be received in and guided along guide grooves 21, 22, respectively formed in the opposed walls of the switch compartment 20R as the actuator 10 is moved upwardly and downwardly in the compartment 2OR.

The vertical movements of the actuator 10 will resiliently bring the first and second contact portions 19C1, 19C2 of the contact spring 19 into and out of slidable contact with the first and second fixed contact members 23C and 24C, respectively. The bottom wall of the compartment 20R is formed with a circular recess 25 to seat in place the coil spring 26, the top end of which is engaged with a boss 17 formed on the bottom surface of the holder block 12 to resiliently urge the actuator 10 outwardly or upwardly.

In the state as shown in FIG. 4A in which the actuator 10 is raised into abutment against the cover 30 by the coil spring 26, the first and second contact portions 19C1, 19C2 are in engagement with the walls of the compartment 2OR, but out of contact with the first and second fixed contact members 23C, 24C, whereby the first and second fixed contact members 23C, 24C are electrically out of contact with each other to turn the switch off.

Upon depressing the actuator 10 down into the compartment against the biasing force of the spring 26, the first and second contact portions 19C1, 19C2 are brought into resilient and slidable contact with the first and second fixed contact members 23C, 24C, whereby the first and second fixed contact members 23C and 24C are electrically connected with each other through the movable contact member 19 to turn the switch on.

Upon the applied force on the actuator 10 being released, the coil spring 26 will again raise the actuator 10 out of engagement with the first and second fixed contact members 23C, 24C to turn the switch off.

With the switch constructed as described above, the first and second contact portions 19C1, 19C2 are moved in slidable contact with the first and second fixed contact members 23C, 24C, and the contact surfaces are cleaned at all times. In addition, a light actuating motion will ensure a good electrical contact, thereby enhancing the reliability of the switch. Another advantage is that the movable contact member 19 may be reduced in thickness and the axial length of the coil spring 26 may also be reduced as compared to the prior art, making it possible to further reduce the size of the switch.

However, as the switch is made more compact, the components thereof are naturally correspondingly reduced in size. By way of illustration, the wire of which the contact spring 19 is formed is typically 0.16 mm in diameter. The length of each of arms 19A is as short as 2 mm and the diameter of the coiled portion 19B is only about 1 mm. Accordingly, in placing (assembling) the movable contact member 19 into the contact holder block 12 of the actuator 10, the use of a pincette to grasp and push the movable contact member into the holder block in a conventional manner would badly reduce the working efficiency as well as possibly deforming the movable contact member as it is inserted, resulting in lowering reliability.

SUMMARY OF THE INVENTION

Accordingly, it is an object of this invention to provide a self-cleaning type microswitch in which the operating efficiency in incorporating the movable contact member into the actuator is improved, and in addition any deformation of the movable contact member being incorporated is prevented to thereby ensure a stable quality.

According to this invention, a switch compartment is formed in a body of electrically insulating material so as to extend into one side face of the body over substantially the entire face. First and second fixed contact members are secured to the opposed inner walls of the compartment. The open top of the compartment is closed by a cover of electrically insulating material having a through-bore.

An actuator having a stem portion is accommodated in the compartment and outwardly biased by a coil spring, with the stem portion protruding out through the through-bore of the cover. The actuator includes a contact holder block joined to the lower end of the stem portion. The holder block has a housing slot extending therethrough from its front end face to the rear end face in a direction perpendicular to said stem portion. The undersurface of the holder block is formed with a guide slit extending therethrough from the front end face to the rear end face in a direction perpendicular to said stem portion and in communication with the housing slot.

The movable contact member is placed into the housing slot by inserting a pin through the coiled portion of the contact member and moving the pin along the guide slit deep into the housing slot.

The holder block is further formed with slit-like windows through the opposed side walls thereof, the windows communicating with the housing slot so that the first and second contact portions of the movable contact member in the housing slot may protrude out through the windows into slidable contact with the first and second fixed contact members.

With the construction as described just above, when the movable contact member is to be assembled into the contact holder block, it is only required to engage the tip of a pin with an aperture or an engagement portion of the movable contact member and then move the pin along the guide slit in the holder block toward said stem portion from the front end face of the holder block to insert the movable contact member into the holder block. The operation of assembling the movable contact member into the holder block is thus greatly facilitated so that comparatively unskilled workers may easily carry out the assembly whereby the working efficiency is highly improved. In addition, the simple movement of the pin along the guide slit is unlikely to cause undesirable deformations of the movable contact member, thereby contributing to producing switches of a stable quality.

BRIEF DESCRIPTION OF THE DRAWINGS

The foregoing summary, as well as the following detailed description, will be better understood when read in conjunction with the appended drawings, in which.

DETAILED DESCRIPTION OF THE PREFERRED EMBODIMENTS

Figure 5:
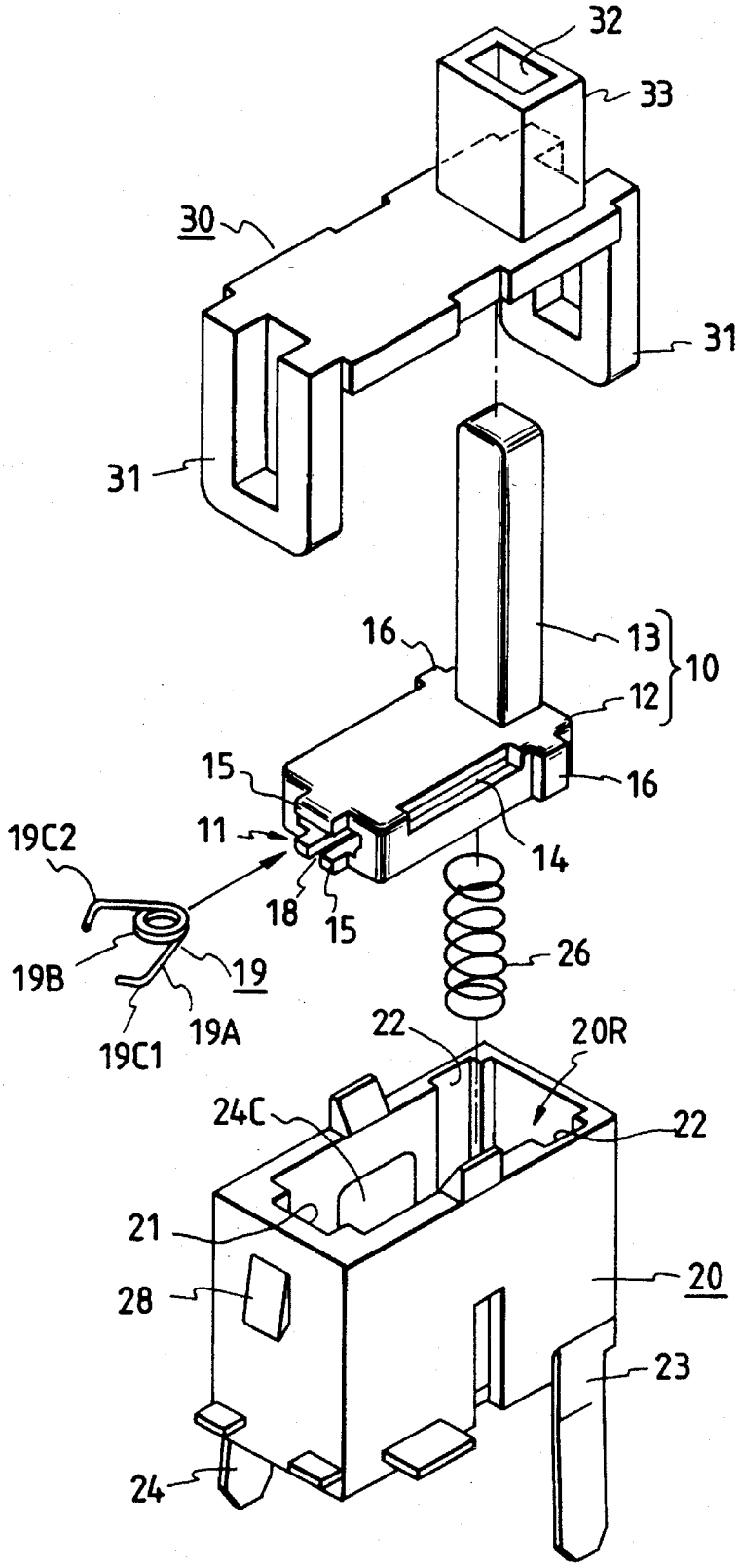
FIG. 5 is an exploded perspective view of the switch according to this invention.

Referring to FIG. 5, there is shown a switch according to an embodiment of this invention in an exploded perspective view. In this embodiment a single actuator is incorporated in a switch body to constitute a self-cleaning type microswitch. In FIG. 5, like reference numerals are used for those components which correspond to components of the prior art microswitch shown in FIG. 1.

Figure 1:
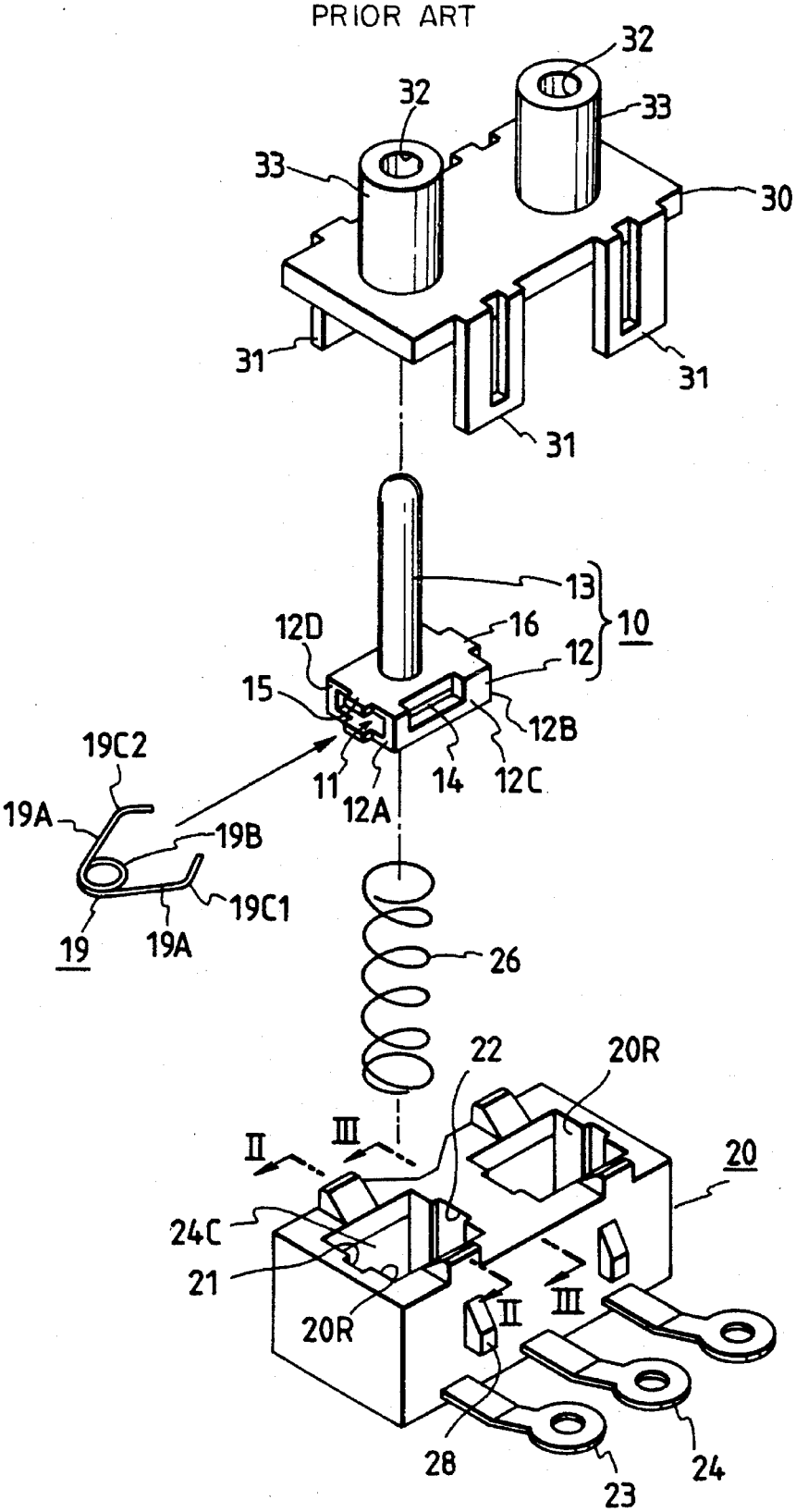
FIG. 1 PRIOR ART
FIG. 1 is an exploded perspective view of a typical example of the prior art switch.
Figure 2:
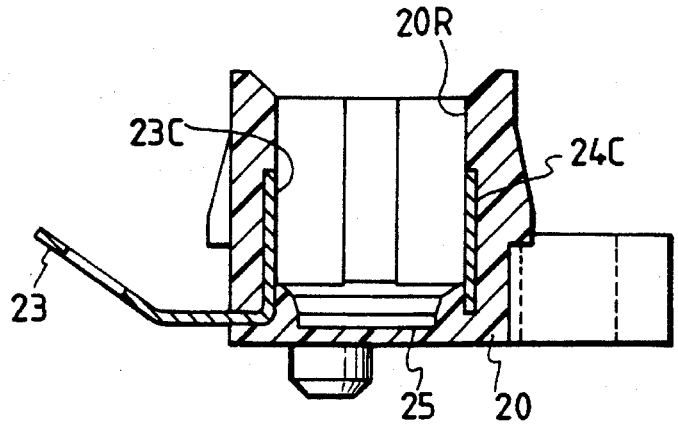
FIG. 2 PRIOR ART
FIG. 2 is a cross-sectional view of the switch taken on line II—II of FIG. 1.
Figure 3:
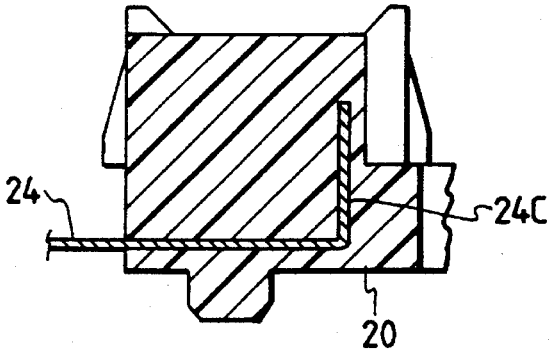
FIG. 3 PRIOR ART
FIG. 3 is a cross-sectional view of the switch taken on line III—III of FIG. 1.
Figure 4A:
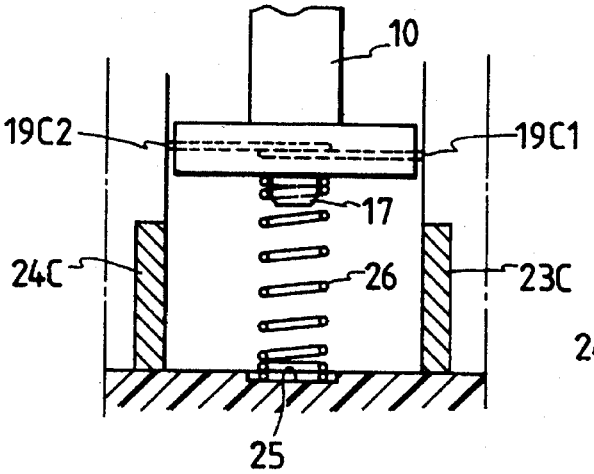
FIG. 4A PRIOR ART
FIG. 4A is an illustration of the switch of FIG. 1 in the OFF state.
Figure 4B:
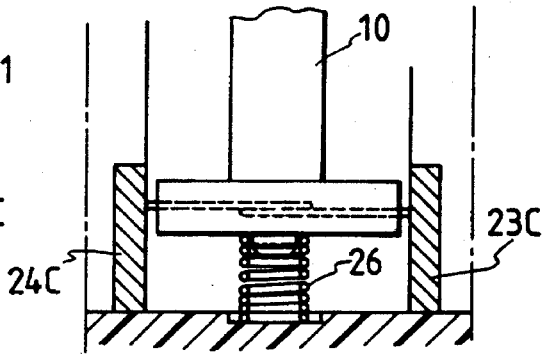
FIG. 4B PRIOR ART
FIG. 4B is an illustration of the switch of FIG. 1 in the ON state.

The most important difference between this invention and the prior art construction shown in FIG. 1 is that a guide slit 18 is formed in the contact holder block 12 of the actuator 10 such that the slit 18 intersects with the housing slot 11 in the block. The principle on which the switch of the invention operates is the same as with the switch of FIG. 1.

In this embodiment of the invention the catch lugs 31 depend from the minor side edges rather than the major side edges of the cover 30. In addition, the stem portion 13 of the actuator 10 is in the form of a post having a rectangular cross-section, and the through-bore 32 of the cover 30 and the tubular guide portion 33 through which the stem portion 13 is inserted has a complementary rectangular cross-section. The present invention will now be described with a focus on the actuator.

Figure 6A:
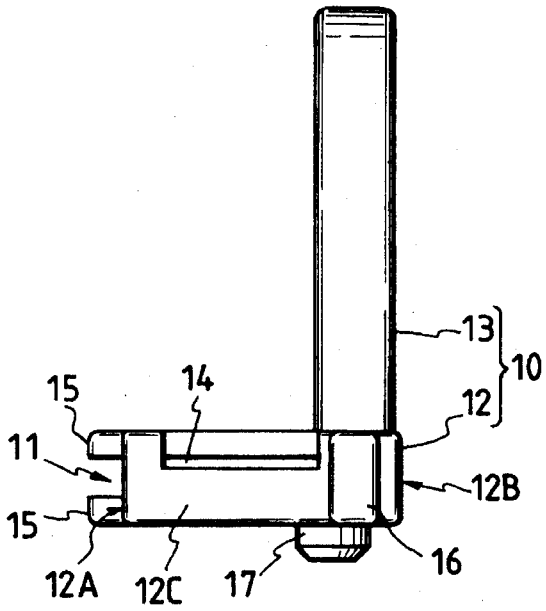
FIG. 6A is an elevational view of an example of the actuator used with the switch of FIG. 5.
Figure 6B:
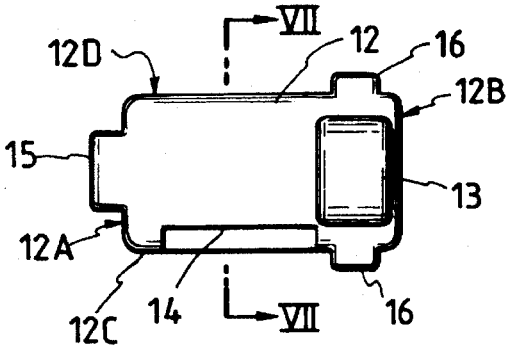
FIG. 6B is a top plan view of the actuator shown in FIG. 6A.

In the embodiment of the invention illustrated in FIG. 5, in this embodiment, the actuator 10 comprises a flat box-shaped (rectangular in plan view) contact holder block 12 and a stem portion 13 rectangular in cross-section upstanding generally vertically from the top surface of the contact holder block 12 adjacent the right end (rear end face 12B) as viewed in FIG. 6A. The actuator 10 is accommodated in a complementarily-shaped open topped switch compartment 20R of a rectangular or box-shaped body 20 formed of an electrically insulating material and is resiliently biased outwardly or upwardly by a coil spring 26, as shown in FIG. 5. The stem portion 13 is telescopically inserted through the through-bore 32 in a cover 30 of electrically insulating material and the tubular guide portion 33 upstanding from the top surface of the cover.

The contact holder block 12 has a flat housing slot 11 dissecting its front end face 12A at the center and extending through the block in a direction perpendicular to stem portion 13 from the front end face toward the rear end face 12B parallel to the top surface of the block.

Figure 7:
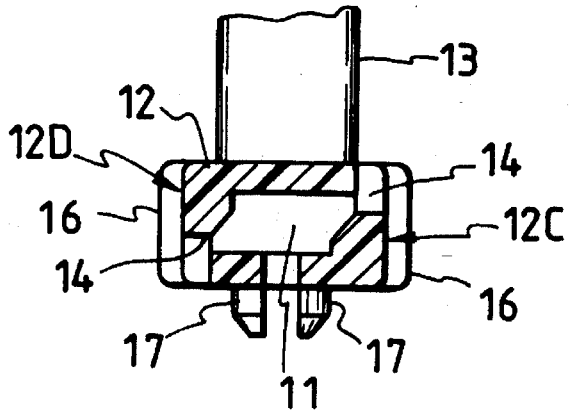
FIG. 7 is a cross-sectional view of the actuator taken on line VII—VII of FIG. 6B.

As shown in FIG. 7, the holder block 12 is further formed with slit-like windows 14 through the opposed side surfaces 12C, 12D in vertically staggered relation to one another, the slits 14 communicating with the housing slot 11 so that when the movable contact spring (contact spring ) 19 shown in FIG. 5 is held in place in the housing slot 11 as will be described hereinafter, the first and second convex contact portions 19C1 and 19C2 of the contact spring 19 may protrude through the slit-like windows 14 outwardly beyond the longitudinal side surfaces 12C and 12D, respectively.

The opposed side surfaces 12C and 12D of the holder block 12 have integral guide projections 16 extending outwardly therefrom where the stem portion 13 is located. Integral guide projections 15 extend generally perpendicularly from the front end face 12A of the slit-like windows 14 above and below the housing slot 11. These guide projections 15 and 16 are adapted to be received in and guided along guide grooves 21, 22, respectively formed in the corresponding inner walls of the switch compartment 20R such that the actuator 10 is slidably moved only vertically up and down in the compartment 2OR.

A pair of opposed arcuate boss portions 17 separated by a guide slit 18 to be described below are formed integrally with the undersurface of the holder block 12. The upper coiled end of the coil spring 26 is adapted to be fitted over the boss portion 17.

Figure 6C:
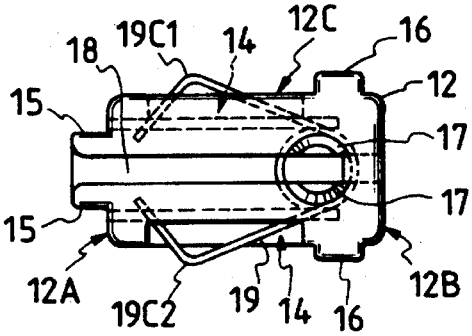
FIG. 6C is a bottom plan view of the actuator shown in FIG. 6A.
Figure 6D:
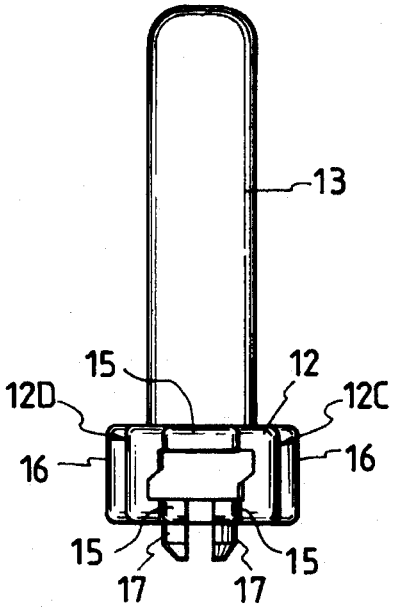
FIG. 6D is a side view of the actuator as viewed from the left hand side of FIG. 6A.
Figure 6E:
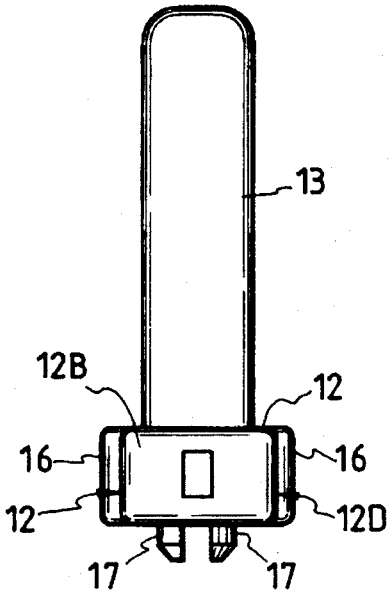
FIG. 6E is a side view of the actuator as viewed from the right hand side of FIG. 6A.

In the present configuration, the contact holder block 12 is further formed through its undersurface with a guide slit 18 located substantially equidistant from the opposed side surfaces 12C and 12D and communicating with the housing slot 11, the guide slit 18 dissecting the lower projection 15 on the front end face in the center and extending in a direction perpendicular to stem portion 13 from the front to the rear of holder block 12 so as to divide the boss 17 into the two arcuate portions 17 illustrated in FIG. 6C. Thus in this embodiment, the lower of the projections 15 is divided by the guide slit 18 into two projection parts, and the boss 17 is also divided by the guide slit 18 into arcuate portions for seating the coil spring 26 thereover as seen in FIGS. 6C and 6D.

Figure 8:
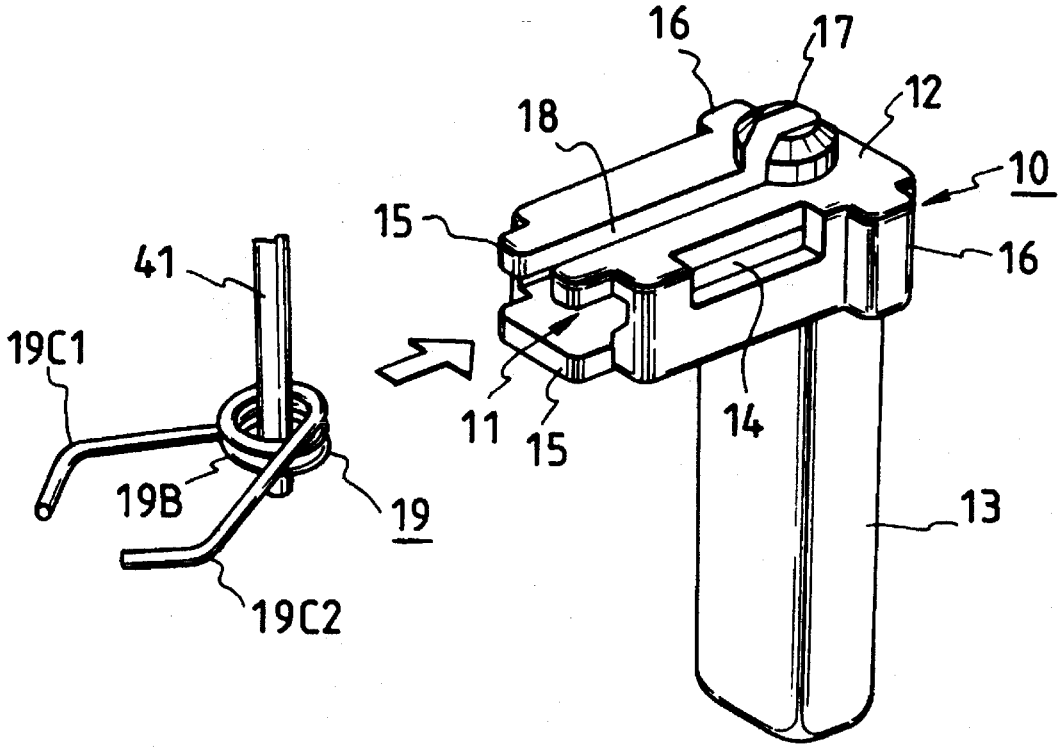
FIG. 8 illustrates the operation of assembling the movable contact member into the holder block of the actuator.

The width of guide slit 18 is sized to permit the passage therethrough of a very thin assembling pin 41 inserted through the coiled portion 19B as shown in FIG. 8 when the movable contact member 19 of FIG. 5 is assembled in position into the housing slot 11, and slit 18 is sufficiently long to permit the movable contact member 19 to be longitudinally moved along housing slot 11 in a direction perpendicular to stem portion 13 until it is assembled in proper position in the housing slot 11.

The movable contact member 19 is made of a single resilient piece of wire bent so as to form a generally V-shape having an included angle of about 70° with a central coiled portion 19B having a few turns to impart sufficient resiliency to the pair of arms 19A. The arms 19A are inwardly bent toward each other at about 90° adjacent their outer free ends to form first and second convex contact portions 19C1 and 19C2. The first and second convex contact portions 19C1, 19C2 of the contact spring 19 protrude out through the slit-like windows 14 of the opposed side surfaces 12C, 12D and are adapted to be slidably moved resiliently into and out of contact with the first fixed contact member 23C (not visible in FIG. 5) and the second fixed contact member 24C, respectively secured to the opposed inner walls of the compartment 20R of the body 20 (FIG. 5) in response to the vertical upward and downward movements of the actuator 10 in the compartment 2OR.

The height of the first and second fixed contact members 23C, 24C is such that they are simultaneously in contact with the corresponding first and second contact portions 19C1 and 19C2 when the actuator 10 is in its lowermost position against the bias of the coil spring 26, and when the actuator 10 is in its uppermost position, at least one of the first and second fixed contact members 23C, 24C is at a position below the elevation of the corresponding one of the first and second contact portions 19C1 and 19C2 so that at least one of the contact portions is out of contact with the corresponding fixed contact member.

In the arrangement according to this invention as described above, when the movable contact member 19 is to be assembled into the housing slot 11 of the contact holder block 12 of the actuator 10, an extremely thin assembling pin 41 may be used. Specifically, as shown FIG. 8, the worker inserts in the tip end of the pin into coiled portion 19B of the movable contact member 19, inserts the movable contact member with the coiled portion 19B in the lead into the housing slot 11, and then moves the pin along the guide slit 18 toward the skim portion 13 and 17. In this way the movable contact member 19 may be easily placed into the housing slot 11 as the opposed arms 19A are resiliently deformed toward each other by the opposed inner walls of the housing slot 11. At a position where the coiled portion 198 abuts against the inner wall of the housing slot 11 adjacent the rear end face 12B of the holder block as illustrated in FIG. 6C, the first and second contact portions 19C1 and 19C2 of the arms 19A protrude through the slit-like windows 14 while the portions of the arms 19A forward of the first and second contact portions 19C1 and 19C2 engage the inner walls of the housing slot 11 at the corners where the housing slot 11 and the corresponding slit-like windows 14 intersect one another to thereby hold the movable contact member 19 in place.

Upon completion of the assembly of the movable contact member 19 into the slot, the pin 41 is removed from the guide slit 18. It is thus to be understood that the movable contact member 19 may be readily inserted into the holder block 12 of the actuator 10. This assembling operation, only requiring movement of the pin 41 along the guide slit 18, may be easily carried out by comparatively unskilled workers, whereby the working efficiency is highly improved. Moreover, the simple movement of the pin along the guide slit is unlikely to cause excessive deformations of the movable contact member, thereby contributing to producing switches of a stable quality.

Figure 9:
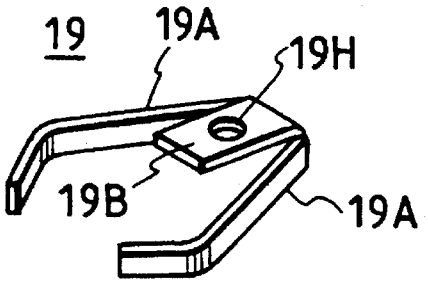
FIG. 9 is a schematic perspective view of an alternate form of the movable contact member.
Figure 10:
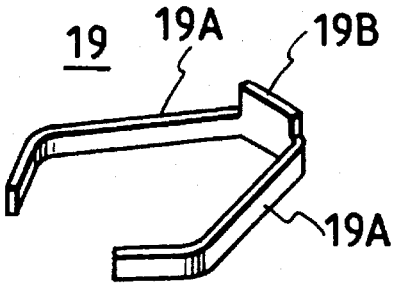
FIG. 10 is a schematic perspective view of still another form of the movable contact member.

While the movable contact member 19 is formed by bending a piece of wire in the embodiment described above, it is understood by those skilled in the art that the movable contact member is not limited to the particular configuration illustrated. Nor is the material for the movable contact member limited to a piece of wire. As illustrated in FIGS. 9 and 10 for example, the movable contact member 19 may be formed by bending a stamped sheet of metal to provide the same effect as the contact member shown in FIG. 8. More specifically, the movable contact member 19 shown in FIG. 9 comprises a stamped metallic sheet having opposed arms 19A and an integral tab 19B formed at the center thereof, the tab 19B being folded forwardly between the opposed arms 19A and having an aperture 19H engageable by an assembling pin 41.

In the modified embodiment shown in FIG. 10, the movable contact member 19 comprises a stamped metallic sheet having opposed arms 19A and an integral tab 19B extending from the opposed arms 19A perpendicularly to a plane containing the arms, the tab 19B being adapted to be engageable by an assembling pin 41 and to be received in the guide slit 18. It is of course to be understood by those skilled in the art that the movable contact members 19 of the various embodiments described above are illustrated only by way of example and may be formed in other configurations.

As indicated above, while the boss portions 17 depending from the undersurface of the actuator 10 are designed to be fitted into the upper end of the coil spring 26 shown in FIG. 5 to position the coil spring upper end, the guide slit 18 along which an assembling pin 41 is moved extends across an between the boss portions 17 so that in placing the movable contact member 19 into the housing slot 11, the coiled portion 19B engaged by the pin 41 may be moved to the distal end of the housing slot 11 adjacent the rear end face 12B of the holder block 12.

Figure 11:
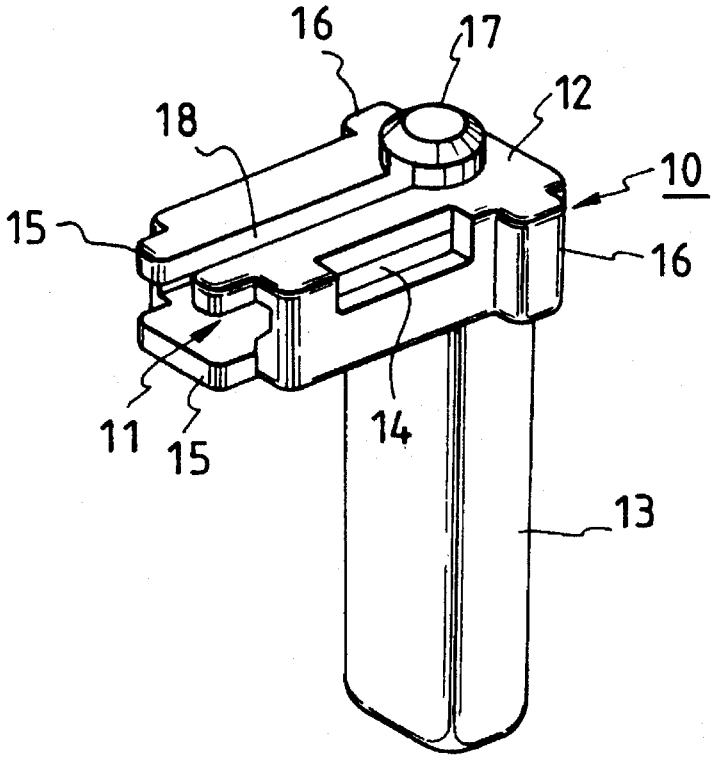
FIG. 11 is a perspective view of yet another form of the movable contact member in its inverted position.

In FIG. 6C, the length of the arms 19A of the movable contact member 19, the point where the arms 19A are bent (the location of the contact portions 19C1, 19C2), the angle at which the free end portions of the arms 19A are bent, etc. may be 50 selected that upon clearing the left ends of the slit-like windows 14 during the movement of the movable contact member 19, the contact portions 19C1, 19C2 will snap into the windows 14 to automatically push the contact member 19 deep into the housing slot 11. In this case, as illustrated in FIG. 11, the boss 17 of the actuator 10 may be formed as a unitary semi-spherical protuberance located adjacent the distal end of the guide slit 18, and the guide slit 18 may terminate short of the boss 17.

In the embodiment of FIG. 8, a part of the upper coiled end of the coil spring 26 can inadvertently intrude into the space between the arcuate protuberances 17. In contrast, the embodiment of FIG. 11 having a non-split boss 17 has the advantage that such problem may be avoided.

As described hereinabove, according to the present invention, the contact holder block on the actuator of a microswitch is formed with a guide slit extending in the direction in which the movable contact member is inserted into the holder block. With this configuration, when the movable contact member is to be assembled into the contact holder block, it is only required to engage the tip of a pin with an engagement portion such as an aperture or a tab of the movable contact member and then move the pin along the guide slit in the holder block whereby the contact member may be readily assembled in place into the holder block. The operation of assembling the contact member into the holder block is thus greatly facilitated to provide the advantage that even less skilled workers may easily carry out the assembly work, so that the working efficiency may be highly improved. In addition, the simple movement of the pin along the guide slit is unlikely to cause excessive deformations of the movable contact member, thereby contributing to producing switches of a stable quality and enhanced reliability.

While specific embodiments of the invention have been shown and described in detail to illustrate the application of the principles of the invention, it will be understood that the invention may be embodied otherwise without departing from the spirit and scope of the invention.

I claim:

1. A self-cleaning type switch comprising:

a body of electrically insulating material having a rectangular switch compartment formed therein, said switch compartment having an open top, a bottom wall and opposed inner walls;

first and second plate-like fixed contact members secured respectively to said opposed inner walls of said switch compartment;

an actuator accommodated in said compartment for slidable movements in directions toward and away from said open top, said actuator including an elongated stem portion having an upper end extending from said compartment through said open top, and a contact holder block connected to a lower end of said stem portion, said holder block having a front end face oriented parallel to said stem portion and having an opening therein, a rear end face oriented parallel to said stem portion, opposed side surfaces extending between said front end face and rear end face, and a top surface and an opposed undersurface each oriented transverse to said stem portion, said contact holder block having a housing slot extending from said opening in said front face toward said rear end face in a direction perpendicular to said stem portion, slit-like windows formed through said opposed side surfaces communicating with said housing slot, and a guide slit extending through said undersurface of said holder block from said opening in said front end face toward said rear end face in communication with said housing slot, said guide slit extending along a line substantially equidistant from said opposed side surfaces, a movable contact member housed in the housing slot of said contact holder block, said movable contact member having been slidably inserted into said housing slot along said guide slit and having first and second movable contact portions resiliently protruding respectively through said slit-like windows in said opposed side surfaces for selective electrical contact with said first and second fixed contact members as said actuator is moved toward and away from said open top of said switch compartment;

biasing spring means disposed between said bottom wall of said switch compartment and said undersurface of said contact holder block for resiliently biasing said actuator toward said open top of said switch compartment; and a cover of an electrically insulating material closing said open top of said switch compartment, said cover having a through-bore through which said stem portion of said actuator protrudes.

2. The switch of claim 1 wherein said movable contact member is formed of a resilient metal material and comprises a pair of opposed arms diverging in the shape of V and a joint portion integrally interconnecting the arms free ends of said opposed arms being inwardly bent toward each other to define said first and second movable contact portions.

3. The switch of claim 2 wherein said joint portion of said movable contact member is positioned in said housing slot closer to said stem portion than the free ends of said opposed arms.

4. The switch of claim 2 wherein said movable contact member is formed of a single piece of resilient metal wire, said joint portion comprising a coiled portion formed at the midpoint of the wire piece.

5. The switch of claim 2 wherein said movable contact member is formed of an elongated resilient metal sheet, said joint portion having a tab extending from the opposed arms perpendicularly to a plane containing the arms.

6. The switch of claim 2 wherein said movable contact member is formed of an elongated resilient metal sheet, said joint portion including a tab extending between the opposed arms and having an engagement aperture.

7. The switch of claim 1 wherein said actuator has a boss formed integrally with the undersurface of the contact holder block for engaging an upper end of said biasing spring means and positioning the biasing spring means in place.

8. The switch of claim 7 wherein said boss comprises a pair of opposed arcuate protuberances separated from each other by said guide slit.

9. The switch of claim 7 wherein said boss comprises a protuberance formed integrally with the undersurface of the contact holder block adjacent a distal end of said guide slit, said protuberance having a semi-spherical top end.

10. The switch of claim 1 wherein each of said first and second fixed contact members has an upper end edge, elevations of the upper end edges of the first and second fixed contact members from said bottom wall of said switch compartment being so selected that when said actuator is in its lowermost position against the biasing force of said biasing spring, the upper end edges of the first and second fixed contact members are above the first and second contact portions of said movable contact member so as to be simultaneously in contact with the corresponding first and second contact portions, and that when the actuator is held in its uppermost position by the biasing spring, the upper end edge of at least one of the first and second fixed contact members is below a corresponding one of the first and second contact portions of the movable contact member so as to be kept out of contact with said movable contact member.

11. The switch of claim 1 wherein the opposed side surfaces of said actuator have integral guide projections extending outwardly therefrom, the opposed inner walls of said switch compartment being formed with guide grooves for receiving said guide projections for slidable movements in the sliding movements of the actuator.

12. The switch of claim 1 wherein said cover has a top surface and an integral guide portion extending perpendicular from said top surface around said through-bore.

13. The switch of claim 1 wherein said stem portion of said actuator has a quadrangular cross-section, said through-bore having a quadrangular cross-section.

* * * * *